US012668887B2

(12) United States Patent
Zhao et al.

(10) Patent No.: US 12,668,887 B2
(45) Date of Patent: Jun. 30, 2026

(54) METHOD AND APPARATUS FOR EXTRACTING LITHIUM FROM SOLUTION USING BIPOLAR ELECTRODES

(71) Applicant: CENTRAL SOUTH UNIVERSITY, Changsha (CN)

(72) Inventors: Zhongwei Zhao, Changsha (CN); Xuheng Liu, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 790 days.

(21) Appl. No.: 18/086,697

(22) Filed: Dec. 22, 2022

(65) Prior Publication Data

US 2023/0212769 A1 Jul. 6, 2023

(30) Foreign Application Priority Data

Jan. 4, 2022 (CN) ..... 202210003622.4

(51) Int. Cl.

| | |
|---|---|
| ***C25C 3/02*** | (2006.01) |
| ***C25C 1/02*** | (2006.01) |
| ***C25C 7/02*** | (2006.01) |
| ***C25C 7/04*** | (2006.01) |

(52) U.S. Cl.

CPC ..... *C25C 1/02* (2013.01); *C25C 7/02* (2013.01); *C25C 7/04* (2013.01)

(58) Field of Classification Search

CPC .... C25C 1/02; C25C 3/02; C25C 7/02; C25C 7/04; C25C 1/00

See application file for complete search history.

(56) References Cited

U.S. PATENT DOCUMENTS

2011/0203929 A1* 8/2011 Buckley ..... C22B 7/006 204/537

FOREIGN PATENT DOCUMENTS

CN 102382984 A 3/2012

OTHER PUBLICATIONS

CN 110724832 to Deng—English Translation of Chinese document (Year: 2020).*

* cited by examiner

*Primary Examiner* — Zulmariam Mendez
(74) *Attorney, Agent, or Firm* — Bayramoglu Law Offices LLC

(57) ABSTRACT

An electrochemical method and an apparatus for extracting lithium from a solution using bipolar electrodes are provided. The apparatus adopts electrodes respectively coated with a lithium-rich electroactive material and a lithium-deficient electroactive material as end plates, which are separated by a plurality of bipolar electrodes coated with a lithium-rich electroactive material and a lithium-deficient electroactive material respectively on two sides, where the side of the bipolar electrode facing the end plate of the lithium-rich electroactive material is coated with the lithium-deficient electroactive material, and the side of the bipolar electrode facing the end plate of the lithium-deficient electroactive material is coated with the lithium-rich electroactive material. The apparatus adopts a conventional voltage, requires a small total current and a simple power supply, greatly reduced the amount of busbar required, allows for easy process control, and is suitable for industrial production.

20 Claims, 5 Drawing Sheets

METHOD AND APPARATUS FOR EXTRACTING LITHIUM FROM SOLUTION USING BIPOLAR ELECTRODES

CROSS REFERENCE TO THE RELATED APPLICATIONS

This application is based upon and claims priority to Chinese Patent Application No. 202210003622.4, filed on Jan. 4, 2022, the entire contents of which are incorporated herein by reference.

TECHNICAL FIELD

The present invention relates to the field of lithium extraction metallurgy, and specifically to an electrochemical method and apparatus for extracting lithium from a solution using bipolar electrodes.

BACKGROUND

Lithium is an important new energy metal. With the development of the new energy industry, the global demand for lithium has surged. Currently, about 70% of the world's lithium is abundant in salt lake brine. How to extract lithium from salt lake brine in an environmentally-friendly and cost-effective manner has attracted more and more attention.

In recent years, lithium extraction methods based on electrochemical deintercalation have received extensive attention. For example, Chinese Patent No. CN 102382984A discloses a method and apparatus for separating magnesium and lithium in salt lake brine and enriching lithium. This method adopts an anion exchange membrane to separate the electrodialysis apparatus into a lithium salt chamber and a brine chamber. The brine chamber is filled with salt lake brine, and the lithium salt chamber is filled with a $Mg^{2+}$-free supporting electrolyte solution. A conductive substrate coated with ion sieve is placed in the brine chamber as a cathode. A conductive substrate coated with a lithium-intercalated ion sieve is placed in the lithium salt chamber as an anode. Driven by an external potential, $Li^+$ in the brine chamber is intercalated into the ion sieve to form a lithium-intercalated ion sieve, and the lithium-intercalated ion sieve in the lithium salt chamber releases $Li^+$ into the electrolyte solution and changes to an ion sieve.

This method has the advantages of short process and simple operation, but has the disadvantages such as cumbersome device assembly, difficulty in maintenance, complicated power supply system, and difficulty in process control.

SUMMARY

It is found by the inventors through continued research that in order to extract more lithium at a time, a plurality of anodes and cathodes need to be alternately disposed in an electrolytic cell, and each of the anodes and cathodes needs to be connected to a positive or negative electrode of an external power supply, to form an industrialized membrane stack electrolytic cell. For this method, the cell voltage is very low (0.5-2 V), but the total working current of the membrane stack is high.

When a large current passes through the conductive busbar of the electrolytic cell, the voltage will gradually drop. The cell voltage of the positive and negative electrodes decreases as the distance of the positive and negative electrodes to terminals of the power supply increases. It can be known through a simple calculation that taking $LiFePO_4$/$FePO_4$ electrode pairs as an example, assuming that the working area of the electrode plate is 1 $m^2$, the current generated by operation of one pair of positive and negative electrodes is 20 amperes, and 50 pairs of electrodes will generate a current of 2000 amperes. If copper having a length of 1 meter and a cross-sectional area of 200 $mm^2$ (thickness by width: 5 by 40 $mm^2$) is used as the conductive busbar (where the resistivity of copper is 0.072 $\Omega \cdot mm^2/m$), the voltage difference across two ends of the copper busbar reaches 0.72 V (2000×0.072/200 V=0.72 volts). The cell voltage of $LiFePO_4$/$FePO_4$ electrodes for lithium extraction is only about 0.2-0.3 V. If the cell voltage of the last pair of positive and negative electrodes needs to be controlled to 0.2-0.3 V, the cell voltage of the electrodes closest to the terminals of the power supply needs to reach 0.9-1 V, which is much higher than the voltage of 0.2-0.3 V required for lithium extraction.

In order to ensure the selectivity of the electrode material to lithium, the cell voltage across each pair of positive and negative working electrodes needs to be strictly limited in practice. Therefore, conventional methods will lead to differences in the reaction performance of the electrode plates at different positions in the electrolytic cell, resulting in unstable operating conditions of the electrolytic cell, poor selectivity of the material to lithium, and reduced reaction degree and cyclability.

Although increasing the amount of busbar can reduce the busbar voltage drop to a certain extent, the investment costs on the busbar also increase sharply. In addition, the low-voltage and high-current operating conditions impose very high requirements on the power supply system, not only a large amount of electric energy is consumed on the conductive busbar, but also the reactive power consumption of the power supply system itself is high. Moreover, the distance between the anode and cathode in the electrolytic cell is small (which often needs to be controlled at about 5 mm for an industrial electrolytic cell), and the connection between each electrode and the busbar is cumbersome, which is not conducive to the industrial assembly and production.

In view of this, the present invention provides a method and apparatus for extracting lithium from a solution using bipolar electrodes, to allow the electrolytic cell to work in a high-voltage and low-current mode, thereby lowering the requirements on the power supply system, reducing the amount of conductive busbar required, and simplifying the process control.

According to a first aspect, the present invention provides an apparatus for extracting lithium from a solution using bipolar electrodes, comprising a cell body, end electrodes, at least one conductive separator, and anion membranes, wherein a number of the anion membranes is greater than a number of the at least one conductive separator;

the end electrodes comprise a first end electrode and a second end electrode respectively disposed at two ends of the cell body, the first end electrode is configured to connect to a first electrode, and the second end electrode is configured to connect to a second electrode; a surface of the first end electrode facing the second end electrode is coated with a lithium-deficient electroactive material, and a surface of the second end electrode facing the first end electrode is coated with a lithium-rich electroactive material;

the at least one conductive separator is disposed inside the cell body to physically divide the cell body into two or more independent chambers, and is located between the first end electrode and the second end electrode; a surface of the at least one conductive separator facing the first end electrode is coated with a lithium-rich electroactive material, and a surface of the at least one conductive separator facing the second end electrode is coated with a lithium-deficient electroactive material; and an anion membrane is disposed in each of the independent chambers to divide the independent chamber into two working areas, the working area on the lithium-deficient electroactive material side is used for introducing a lithium-containing raw material solution and is called a first working area, and the working area on the lithium-rich electroactive material side is located is used for introducing a supporting electrolyte solution and is called a second working area.

The lithium-rich electroactive material and the lithium-deficient electroactive material are respectively coated on two sides of a separator material which is electronically conductive but non-ionically conductive to form a bipolar electrode. A plurality of the bipolar electrodes obtained by coating are inserted into an electrolytic cell, the first end electrode and the second end electrode are respectively placed at two ends of the electrolytic cell, and the first end electrode and the second end electrode are respectively connected to positive and negative electrodes of a power supply. After the power supply is turned on, the bipolar electrode generates an induced electric field, and induced positive charges are generated on the side coated with the lithium-rich electroactive material, to cause the oxidation of the transition metal in the lithium-rich electroactive material, i.e., lithium deintercalation; at the same time, induced negative charges are generated on the side coated with the lithium-deficient electroactive material, to cause the reduction of the transition metal in the lithium-deficient electroactive material to intercalate lithium in the lithium-containing solution into the material.

Because only the two ends of the electrolytic cell are connected to the positive and negative electrodes of the power supply and the working of the bipolar electrode is based on the formation of an induced electric field to generate different surface charges or induced electric fields on the two sides of the electrode, the current passing through the lithium-deficient electroactive material of each bipolar electrode is the same, and the reaction progress and degree of the entire system are synchronous, allowing for easy process control. In addition, the electrolytic cell works in a conventional-voltage and low-current mode, thereby lowering the requirements on the power supply system, reducing the amount of conductive busbar required, and simplifying the voltage wiring.

Preferably, the first end electrode, the second end electrode, the at least one conductive separator, and the anion membranes are disposed in parallel with each other.

Preferably, a plurality of the conductive separators are spaced apart from each other by a same distance.

Further, for the anion membranes, anion membranes having different impurity ion trapping capabilities may be selected according to production needs and prices.

Further, according to the viscosity of the lithium-containing solution and the solution feeding rate, liquid distribution nets or liquid distribution baffles may be disposed on two sides of the anion membrane to improve the uniform distribution of the solution in the chamber.

Further, at least one engagement groove for mounting the at least one conductive separator is provided in the cell body.

Further, the lithium-rich electroactive material is one or a mixture of more than one of $LiFePO_4$, $LiMn_2O_4$, $LiMeO_2$, and doped derivatives thereof, wherein Me is one or more of Ni, Co, or Mn. The above-mentioned electroactive materials have the characteristics of transport and migration channels and redox reaction sites for lithium ions as well as chemically stable lattice structures, and should have a stable electrochemical working window in an aqueous solution. By controlling the redox potential of the electrode surface, lithium ions can be selectively intercalated and deintercalated in the material.

Further, the lithium-deficient electroactive material is prepared by oxidizing the lithium-rich electroactive material to remove part or all of lithium.

Specifically, conventional chemical oxidation and electrochemical oxidation methods can be used to oxidize low-valent transition metals in $LiFePO_4$, $LiMn_2O_4$, and $LiMeO_2$ (wherein Me is one or more of Ni, Co, or Mn) to high-valent ones, in which case $Li^+$ ions escape from the lattices, thus forming a lithium-deficient material. During this process, the original crystal structure of $LiFePO_4$, $LiMn_2O_4$, and $LiMeO_2$ (wherein Me is one or more of Ni, Co, or Mn) remains basically unchanged, and has the characteristics of selective intercalation of lithium by reduction.

Further, the at least one conductive separator is dense carbon paper; dense carbon fiber sintered cloth; graphite plate; corrosion-resistant intermetallic compound plate; ruthenium-coated titanium sheet; a plate of gold, a platinum group metal, and/or an alloy thereof; or a plate of titanium, zirconium, hafnium, tantalum, niobium, and/or an alloy thereof.

In the method of the present invention, the two sides of the conductive separator have different polarities (positive and negative) respectively during the lithium extraction process, so such separators are required not only to be electronically conductive, but also to be resistant to corrosion caused by electrochemical oxidation and electrochemical reduction.

According to a second aspect, the present invention further provides a method for extracting lithium from a solution using bipolar electrodes, comprising the following steps:

step 1: taking the above-mentioned apparatus for extracting lithium from a solution using bipolar electrodes, introducing a lithium-containing raw material solution into the first working area, and introducing a supporting electrolyte solution into the second working area;

step 2: connecting the first end electrode to a negative electrode of a power supply, connecting the second end electrode to a negative electrode of the power supply, turning on the power supply, a current flowing in from the second end electrode and being outputted from the first end electrode, and at the same time, the following changes occur:

lithium ions in the raw material solution in the first working area are intercalated in the adjacent lithium-deficient electroactive material, and the lithium-deficient electroactive material gradually becomes a lithium-rich electroactive material; and lithium ions are deintercalated from the lithium-rich electroactive material in the second working area and enter the supporting electrolyte solution, and the lithium-rich electroactive material gradually becomes a lithium-deficient electroactive material;

step 3: when the reaction is completed, indicating that the raw material solution has changed into a lithium-deficient solution and the supporting electrolyte solution has changed into a lithium-rich solution, disconnecting the power supply, discharging the lithium-deficient solution, and collecting the lithium-rich solution; and step 4: cleaning the cell body, connecting the first end electrode to the positive electrode of the power supply, connecting the second end electrode to the negative electrode of the power supply, and repeating the steps 1-3.

Further, the lithium-rich solution from one cycle is used as the supporting electrolyte solution in a next cycle for lithium extraction to increase the concentration of lithium in the solution; and the lithium-deficient solution from one cycle is used as the raw material solution for lithium extraction in a next cycle to improve the recovery rate of lithium.

Further, the raw material solution for lithium extraction is one or a mixture of more than one of raw salt lake brine, brine of any stage obtained by treatment of original brine, old brine, underground brine, oil field brine, a lithium-containing solution obtained from ore decomposition and secondary resource recovery, or a lithium precipitation mother liquor.

Further, due to the difference between the potentials of the electroactive materials for lithium intercalation and deintercalation (about 0.4-0.6 V vs. SHE for $LiFePO_4$, about 0.7-1.0 vs. SHE for $LiMn_2O_4$, and 0.7-1.0 vs. SHE for the ternary material $LiMeO_2$), the voltage required during the lithium extraction process varies with different materials coated on the two sides of the bipolar electrode. In addition, the required voltage can also be adjusted within a certain range according to different concentrations of lithium in the lithium-containing solution. It can be understood that for low lithium concentration and high impurity content, a slightly lower cell voltage can be used to ensure the material selectivity; and for the lithium-containing solution having high lithium concentration and low impurity content, a higher cell voltage can be used to increase the rate of lithium extraction while ensuring the selectivity of lithium extraction.

Specifically, a value of a voltage of the power supply is (0.1-1.0)×n V, wherein n is a number of the independent chambers.

Preferably, when the electroactive material is $LiFePO_4$ or a derivative thereof, an external voltage applied is (0.1-0.5)×n V;

when the electroactive material is $LiMn_2O_4$ or a derivative thereof, an external voltage applied is (0.3-0.6)×n V;

when the electroactive material is $LiMeO_2$ or a derivative thereof, an external voltage applied is (0.4-0.8)×n V;

when the electroactive material is $LiMn_2O_4$, $LiFePO_4$, and a derivative thereof, an external voltage applied is (0.3-0.7)×n V;

when the electroactive material is $LiMn_2O_4$, $LiMeO_2$, and a derivative thereof, an external voltage applied is (0.4-0.9)×n V; or when the electroactive material is $LiFePO_4$, $LiMeO_2$, and a derivative thereof, an external voltage applied is (0.4-1.0)×n V.

The beneficial effects of the present invention are as follows:

1. Only the electrodes at two ends are connected to the power supply, and the resulting induced electric field drives the bipolar electrodes in the entire electrolytic cell to work, thereby realizing the synchronous reaction of the electroactive materials inside the electrolytic cell, and improving the stability and cyclability of the electrode materials of the electrolytic cell.
2. The current in the electrolytic cell passes through each bipolar electrode in turn, and the current is small, which lowers the requirements on the control precision and manufacturing of the power supply, thereby reducing the reactive power consumption, and the costs.
3. The use of a large amount of conductive copper busbar required for the connection of electrodes inside the electrolytic cell is avoided, which fundamentally solves the problem of tedious operation required for connecting each electrode to the positive and negative electrodes of the power supply in the prior art.
4. Lithium desorption and adsorption occur at the same time on the two sides of the adsorption electrode, which realizes the extraction and enrichment at the same time, achieving high efficiency.

BRIEF DESCRIPTION OF THE DRAWINGS

To describe the technical solutions in the embodiments of the present invention more clearly, the following briefly describes the accompanying drawings required for describing the embodiments. Apparently, the accompanying drawings in the following description show merely some embodiments of the present invention, which cannot be considered as limitation on the scope. For persons of ordinary skill in the art, other drawings may be obtained according to these accompanying drawings without creative efforts.

Reference signs: 1—cell body, 2—end electrode, 3—lithium-deficient electroactive material, 4—lithium-rich electroactive material, 5—anion membrane, 6—power supply, 7—conductive separator.

DETAILED DESCRIPTION OF THE EMBODIMENTS

To make the objects, technical solutions and advantages of the present invention clearer, the technical solutions of the present application will be described in detail below. Apparently, the embodiments described are merely some embodiments, rather than all of the embodiments of the present application. All other embodiments obtained by a person of ordinary skill in the art without creative efforts based on the embodiments of the present invention shall fall within the protection scope of the present invention.

Figure 1:
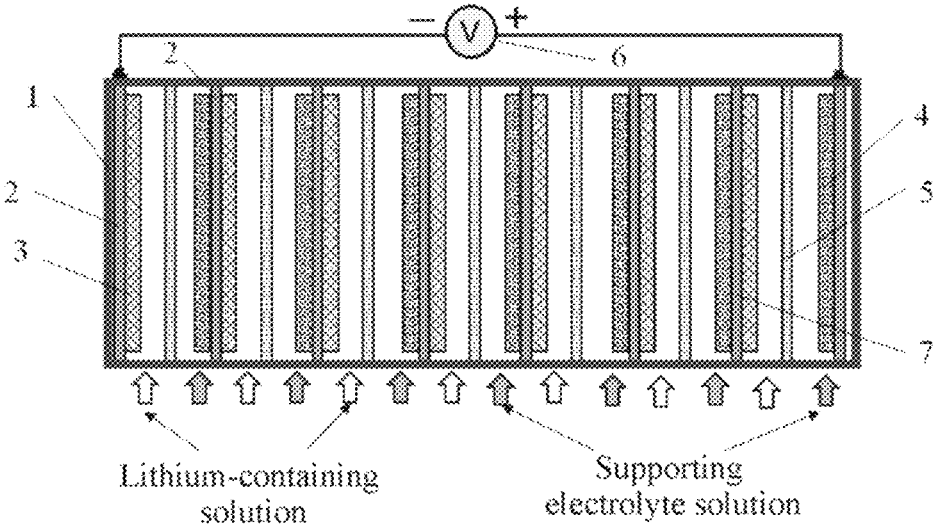
FIG. 1 is a simplified schematic diagram of an apparatus for extracting lithium from a solution using bipolar electrodes according to the present invention.
Figure 2A:
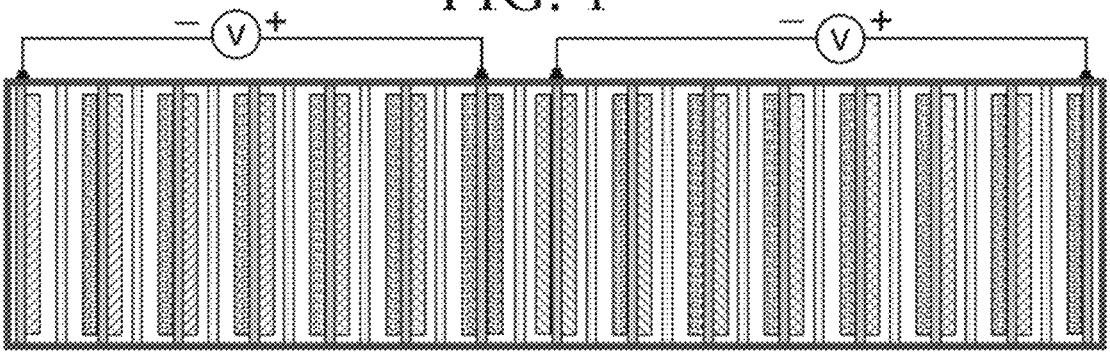
FIG. 2A is a first simplified schematic structural diagram of an integration of the apparatuses in FIG. 1 connected in series.
Figure 2B:
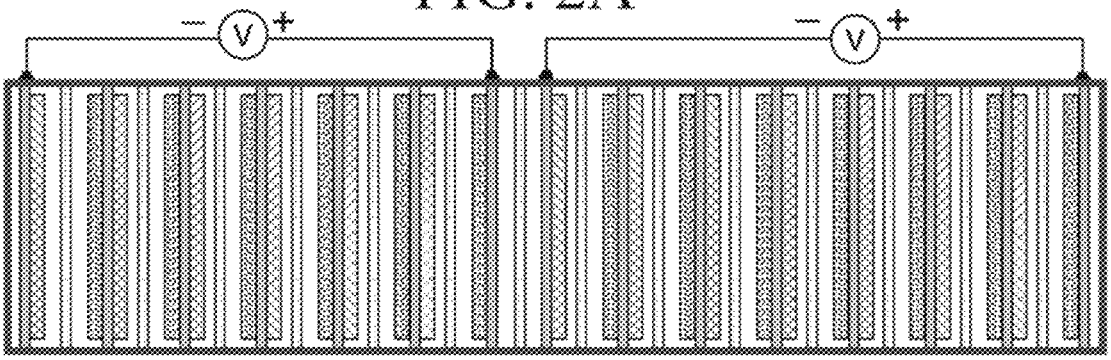
FIG. 2B is a second simplified schematic structural diagram of an integration of the apparatuses in FIG. 1 connected in series.

FIG. 1 is a simplified schematic diagram of an apparatus for extracting lithium from a solution using bipolar electrodes according to the present invention; FIG. 2A and FIG. 2B are simplified schematic structural diagrams of a front view of an integration of the apparatuses in FIG. 1 connected in series.

Referring to FIG. 1, FIG. 2A and FIG. 2B, the apparatus includes a cell body 1, end electrodes 2, at least one conductive separator 7, and anion membranes 5, wherein a number of the anion membranes 5 is greater than a number of the at least one conductive separator 7.

The end electrodes 2 comprise a first end electrode and a second end electrode respectively disposed at two ends of the cell body 1, the first end electrode is configured to connect to a first electrode, and the second end electrode is configured to connect to a second electrode. A surface of the first end electrode facing the second end electrode is coated with a lithium-deficient electroactive material 3, and a surface of the second end electrode facing the first end electrode is coated with a lithium-rich electroactive material 4.

The at least one conductive separator 7 is disposed inside the cell body 1 to physically divide the cell body 1 into two or more independent chambers, and is located between the first end electrode and the second end electrode. A surface of the at least one conductive separator 7 facing the first end electrode is coated with a lithium-rich electroactive material 4, and a surface of the at least one conductive separator 7 facing the second end electrode is coated with a lithium-deficient electroactive material 3.

An anion membrane 5 is disposed in each of the independent chambers to divide the independent chamber into two working areas, the working area on the lithium-deficient electroactive material 3 side is used for introducing a lithium-containing raw material solution and is called a first working area, and the working area on the lithium-rich electroactive material 4 side is located is used for introducing a supporting electrolyte solution and is called a second working area.

As shown in FIG. 1, the number of conductive separators 7 is six, the number of anion membranes 5 is seven, the conductive separators 7 divide the cell body 1 into seven independent chambers, and the seven anion membranes 5 are respectively disposed in the seven independent chambers. The material of the conductive separator 7 may be the same as or different from the material of the first end electrode and the second end electrode, or may not be the same, which is not limited in this application. It should be noted that the number of the conductive separators 7 is not limited to six, and can be set according to specific lithium extraction requirements.

FIG. 2A is a first simplified structural diagram of the device in which the device in FIG. 1 is integrated in series, that is, when the number of bipolar electrodes in a single electrolytic cell is too large, they can be divided into modules according to the output power of the power supply for control. FIG. 2B is a second simplified schematic structural diagram of an integration of the apparatuses in FIG. 1 connected in series, that is, the power supply systems of a plurality of electrolytic cells are connected in series for operation. Referring to FIG. 2A and FIG. 2B, the apparatuses provided in the present application can also be integrated in series, so as to extract lithium from more lithium-containing raw material solutions. In addition, the solution transportation in the electrolytic cell can be carried out by independent liquid circuits connected in series or parallel according to actual needs.

The present invention will be further described in detail below with reference to examples.

(1) A lithium iron phosphate material was added as a lithium-rich electroactive material to a 0.1 mol/L sodium persulfate solution with the molar ratio of lithium iron phosphate to sodium persulfate being controlled to 2:1, reacted at room temperature for 6 hours, and then filtered, washed, and dried to give lithium-deficient iron phosphate obtained by preliminary lithium deintercalation.

(2) Lithium iron phosphate, acetylene black, and polyvinylidene fluoride (PVDF) were fully mixed and homogenized by stirring at a ratio of 8:1:1 in N-methylpyrrolidone as a solvent using a double planetary mixer for 8 hours to obtain a lithium iron phosphate slurry. (1) The lithium-deficient iron phosphate obtained in step (1), acetylene black, and polyvinylidene fluoride (PVDF) were fully mixed and homogenized by stirring at a ratio of 8:1:1 in N-methylpyrrolidone as a solvent using a double planetary mixer for 8 hours to obtain an iron phosphate slurry.

(3) The lithium iron phosphate slurry and the iron phosphate slurry obtained in step (2) were coated on two 60×60 $cm^2$ titanium sheets respectively (where the coating area was the middle 50×50 $cm^2$ part) with a single-side coating density of 150 $mg/cm^2$, and then vacuum-dried at 90° C. for 12 hours to obtain two end electrodes. The lithium iron phosphate slurry and the iron phosphate slurry obtained in step (2) were coated on two sides of each of nine 60×60 $cm^2$ titanium sheets respectively (where the coating area was the middle 50×50 $cm^2$ part) with a single-side coating density of 150 $mg/cm^2$, and then vacuum-dried at 90° C. for 12 hours to obtain nine bipolar electrodes.

(4) The two end electrodes, the nine bipolar plates, and 10 anion membranes were assembled in the manner shown in FIG. 1 to obtain a lithium extraction electrolytic cell. The end electrode coated with the lithium iron phosphate material was connected to a positive electrode of a power supply, and the end electrode coated with the iron phosphate material was connected to a negative electrode of the power supply.

(5) 300 L of salt lake brine (having a composition as shown in Table 1) was continuously injected into the first working area (that is, the side of the electrode coated with the iron phosphate material), and 20 L of 5 g/L NaCl was injected into the second working area (that is, the side of the electrode coated with the lithium iron phosphate material) as the supporting electrolyte. Lithium extraction tests were carried out by controlling the applied external voltage to 1.0 V, 3.0 V and 4.5 V respectively and controlling the solution temperature to about 5° C. The composition of the salt lake brine in Example 1 is as shown in Table 1. When the current in the lithium extraction process dropped to 10% of the initial current, the lithium extraction process was ended. The variations of concentrations in brine during the lithium extraction process were as shown in Table 2 and FIG. 3. The variation of the lithium concentration in the lithium-rich solution was as shown in FIG. 4. The cycle performance was as shown in FIG. 5.

As can be seen from Table 2, when the cell voltages were 1.0 V, 3.0 V, and 4.5 V respectively, the concentration of lithium in the brine was reduced from the initial 0.41 g/L to 0.09 g/L, 0.05 g/L, and 0.1 g/L respectively, the lithium extraction rates reached 78%, 87.8%, and 75.6% respectively, and the concentration of lithium in the lithium-rich solution reached 4.74 g/L, 5.34 g/L, and 4.63 g/L respectively. The lithium concentration is enriched 10 times, and the obtained lithium-rich solution has a low content of other impurities, which greatly reduces the subsequent purification workload.

Figure 3:
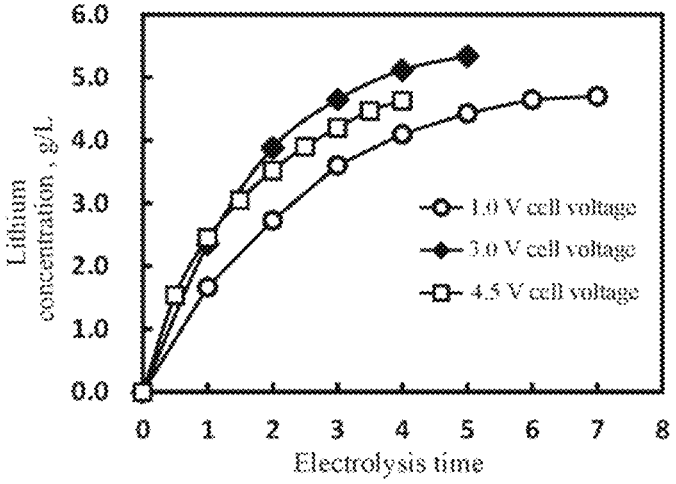
FIG. 3 shows the variation of lithium concentration in the lithium-rich solution with time at different cell voltages in Example 1.
Figure 4:
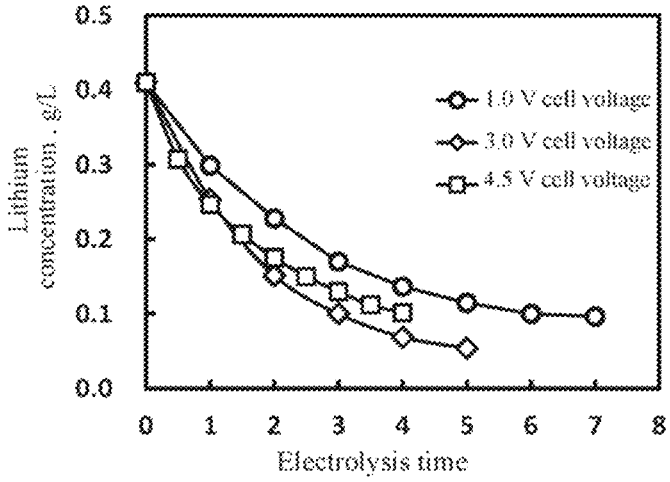
FIG. 4 shows the variation of lithium concentration in salt lake brine with time at different cell voltages in Example 1.
Figure 5:
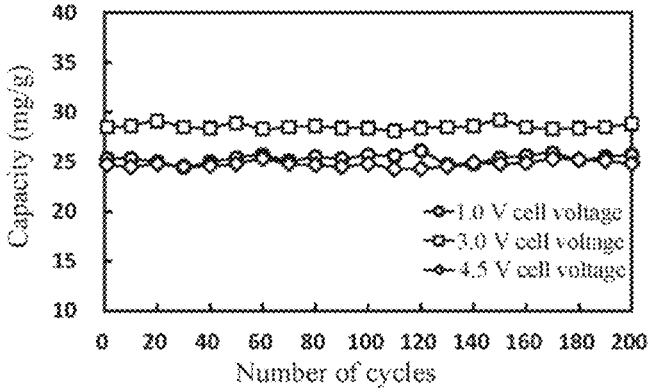
FIG. 5 shows the adsorption capacity and cycle performance of the material at different cell voltages in Example 1.

It can be seen from FIG. 3 to FIG. 5 that the time used for the lithium extraction process and the adsorption capacity of the material to lithium slightly vary with different cell voltages. A higher cell voltage can improve the lithium extraction rate, but cause a slight decrease in the adsorption capacity. When the cell voltages were 1.0 V, 3.0 V, and 4.5 V respectively, the average currents during the process were 5.2 A, 8.1 A, and 8.9 A respectively, the adsorption capacities were about 25 mg(Li)/g, 28.5 mg(Li)/g, and 24.5 mg(Li)/g respectively, and the cycle performance of the system was excellent.

TABLE 1

Main ionic components of salt lake brine (g/L)

| Element | Li | Na | Mg | K | B | $SO_4^{2-}$ |
|---|---|---|---|---|---|---|
| Salt lake brine | 0.41 | 62.10 | 52.30 | 3.46 | 1.67 | 16.45 |

TABLE 2

Main components of brine and anode lithium-rich solution after lithium extraction (g/L)

| Cell voltage | Solution | Li | Na | Mg | K | B | $SO_4^{2-}$ |
|---|---|---|---|---|---|---|---|
| 1.0 V | Brine after lithium extraction | 0.09 | 61.79 | 52.04 | 3.44 | 1.66 | 16.37 |
| | Lithium-rich solution | 4.74 | 6.66 | 3.92 | 0.26 | 0.13 | 1.23 |
| 3.0 V | Brine after lithium extraction | 0.05 | 61.85 | 52.09 | 3.45 | 1.66 | 16.38 |
| | Lithium-rich solution | 5.34 | 5.73 | 3.14 | 0.21 | 0.10 | 0.99 |
| 4.5 V | Brine after lithium extraction | 0.10 | 61.91 | 52.14 | 3.45 | 1.66 | 16.39 |
| | Lithium-rich solution | 4.63 | 4.79 | 2.35 | 0.18 | 0.09 | 0.86 |

Example 2

The difference between this example and Example 1 lies in that the lithium-rich electroactive material used was $LiMn_2O_4$, from which lithium-deficient $Li_{1-x}Mn_2O_4$ (wherein x=0.5-0.95, and in this example, x is 0.8) was prepared by performing step (1) in Example 1; and end electrodes and bipolar electrodes were prepared using $Li_{0.2}Mn_2O_4$ and $LiMn_2O_4$ as lithium extraction materials respectively by the method in Example 1, and assembled into a lithium extraction apparatus. The volume of salt lake brine was 250 L, the volume of the supporting electrolyte solution was 50 L, and the cell voltage in the lithium extraction process was 5.0 V.

Example 3

The difference between this example and Example 1 lies in that the lithium-rich electroactive material used was $LiNi_{0.5}Co_{0.2}Mn_{0.3}O_2$, from which lithium-deficient $Li_{1-x}Ni_{0.5}Co_{0.2}Mn_{0.3}O_2$ (wherein x=0.5-0.95, and in this example, x is 0.85) was prepared by performing step (1) in Example 1; and end electrodes and bipolar electrodes were prepared using dense carbon papers as conductive separators and using $Li_{0.15}Ni_{0.5}Co_{0.2}Mn_{0.3}O_2$ and $LiNi_{0.5}Co_{0.2}Mn_{0.3}O_2$ as lithium extraction materials respectively by the method in Example 1, and assembled into a lithium extraction apparatus. The volume of salt lake brine was 200 L, the volume of the supporting electrolyte solution was 50 L, and the cell voltage was controlled to 6.0 V.

Example 4

The difference between this example and Example 1 lies in that two materials, $LiFePO_4$ and $LiMn_2O_4$ were used as active materials, wherein lithium-deficient $Li_{1-x}FePO_4$ (wherein x=0.8-0.95, and in this example, x is 0.9) was prepared from $LiFePO_4$ by performing step (1) in Example 1; and end electrodes and bipolar electrodes were prepared using graphite plates as conductive separators and using $Li_{0.1}FePO_4$ and $LiMn_2O_4$ as lithium extraction materials respectively by the method in Example 1, and assembled into a lithium extraction apparatus. The volume of salt lake brine was 250 L, the volume of the supporting electrolyte solution was 50 L, and the cell voltage in the lithium extraction process was controlled to 4.5 V.

Example 5

The difference between this example and Example 1 lies in that two materials, $LiFePO_4$ and $LiNi_{0.5}Co_{0.2}Mn_{0.3}O_2$ were used as active materials, wherein lithium-deficient $Li_{1-x}FePO_4$ (wherein x=0.8-0.95, and in this example, x is 0.9) was prepared from $LiFePO_4$ by performing step (1) in Example 1; and end electrodes and bipolar electrodes were prepared using ruthenium-coated titanium sheets as conductive separators and using $Li_{0.1}FePO_4$ and $LiNi_{0.5}Co_{0.2}Mn_{0.3}O_2$ as lithium extraction materials respectively by the method in Example 1, and assembled into a lithium extraction apparatus. The volume of salt lake brine was 250 L, the volume of the supporting electrolyte solution was 50 L, and the cell voltage in the lithium extraction process was controlled to 6.0 V.

Example 6

The difference between this example and Example 1 lies in that two materials, $LiMn_2O_4$ and $LiNi_{0.5}Co_{0.2}Mn_{0.3}O_2$ were used as active materials, wherein lithium-deficient $Li_{0.3}Mn_2O_4$ was prepared from $LiMn_2O_4$ by performing step (1) in Example 1; and end electrodes and bipolar electrodes were prepared using $Li_{0.3}Mn_2O_4$ and $LiNi_{0.5}Co_{0.2}Mn_{0.3}O_2$ as lithium extraction materials respectively by the method in Example 1, and assembled into a lithium extraction apparatus. The volume of salt lake brine was 250 L, the volume of the supporting electrolyte solution was 50 L, and the cell voltage in the lithium extraction process was controlled to 7.0 V.

Figure 6:
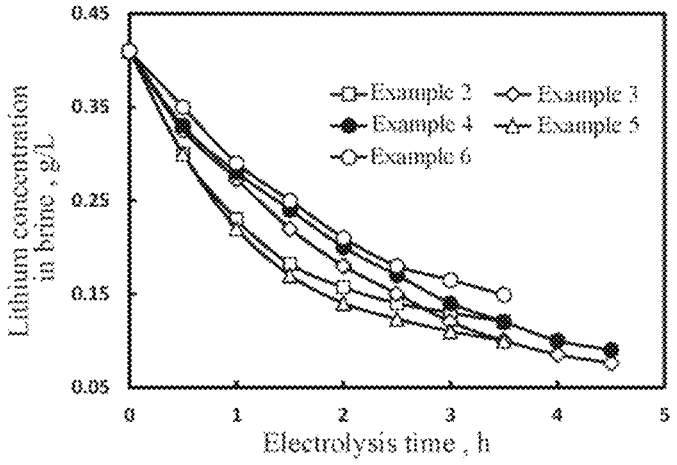
FIG. 6 shows the variation of lithium concentration in brine with time in the lithium extraction process in Examples 2-6.
Figure 7:
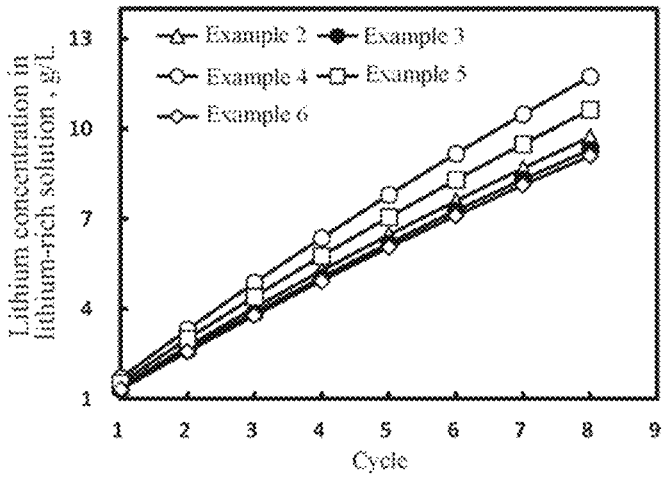
FIG. 7 shows the variation of lithium concentration in the supporting electrolyte during the cyclic use in Examples 2-6.
Figure 8:
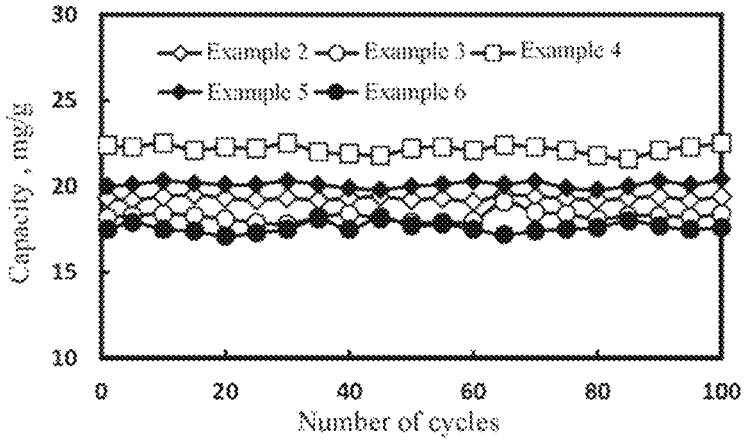
FIG. 8 shows the variation of the adsorption capacity with cycles in Examples 2-6.

The compositions of the lithium-rich solutions obtained after the lithium extraction processes of Examples 2-6 were as shown in Table 3. The variation of the lithium concentration in the brine was as shown in FIG. 6. The supporting electrolyte (lithium-rich solution) was recycled for many times, and the brine is replaced with new brine after the lithium extraction process. The variation of the lithium concentration in the lithium-rich solution was as shown in FIG. 7. The adsorption capacity and cycle performance of Examples 2-6 were as shown in FIG. 8.

It can be seen from Table 3 and FIG. 6 that although the lithium extraction systems adopting different lithium-containing electroactive materials had slightly different lithium extraction performance, the overall selectivities of the systems were good. It can be seen from FIG. 7 that the recycling of the lithium-rich solution can continuously increase the lithium concentration, thereby achieving further enrichment of lithium. It can be seen from FIG. 8 that although the lithium extraction systems adopting different electroactive materials had slightly different lithium extraction capacities, the cycle performance of the systems was excellent, and the average current in the process was 7-8 A.

TABLE 3

Concentrations (g/L) of lithium in lithium-rich solution obtained in Examples 2-6 and brine

| Example | Lithium extraction system | Voltage | Brine Residual lithium | Ion concentration in lithium-rich solution Li | Na | Mg | K |
|---|---|---|---|---|---|---|---|
| Example 2 | $LiMn_2O_4$ and $Li_{0.2}Mn_2O_4$ | 5.0 V | 0.12 | 1.40 | 3.29 | 1.05 | 0.11 |
| Example 3 | $Li_{0.15}Ni_{0.5}Co_{0.2}Mn_{0.3}O_2$ and $LiNi_{0.5}Co_{0.2}Mn_{0.3}O_2$ | 6.0 V | 0.076 | 1.34 | 3.23 | 0.98 | 0.09 |
| Example 4 | $Li_{0.1}FePO_4$ and $LiMn_2O_4$ | 4.5 V | 0.073 | 1.69 | 3.16 | 1.04 | 0.12 |
| Example 5 | $Li_{0.1}FePO_4$ and $LiNi_{0.5}Co_{0.2}Mn_{0.3}O_2$ | 6.0 V | 0.1 | 1.53 | 3.21 | 1.11 | 0.11 |
| Example 6 | $Li_{0.3}Mn_2O_4$ and $LiNi_{0.5}Co_{0.2}Mn_{0.3}O_2$ | 7.0 | 0.149 | 1.31 | 3.15 | 0.95 | 0.1 |

Example 7

The difference between this example and Example 1 lies in that the salt lake brine used was carbonate type brine, and the pH of the solution was 9.5. 3.5 V was used for electrolytic extraction of lithium, the volume of salt lake brine was 200 L, and the volume of the supporting electrolyte solution was 50 L. The compositions of the salt lake brine and the supporting electrolyte before and after lithium extraction were as shown in Table 4. The variation of the lithium concentration in the brine and the supporting electrolyte solution with time was as shown in FIG. 9.

Figure 9:
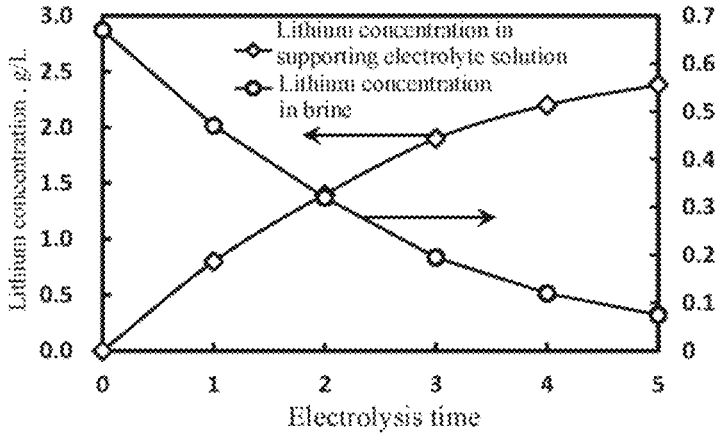
FIG. 9 shows the variation of lithium concentration in brine and the supporting electrolyte in the lithium extraction process in Example 7.

As can be seen from Table 4 and FIG. 9, the method of the present invention also has good adaptability to carbonate type brine. After 0.67 g/L brine was treated for 5 hours, the lithium concentration in the brine was reduced to 0.08 g/L (wherein the recycling of the brine can achieve further lithium extraction), and the lithium extraction rate reached up to 88%. One cycle was carried out until the concentration of lithium in the electrolyte reached 2.38 g/L, and the trapping rate for other impurity ions reached 99% or more.

Figure 10:
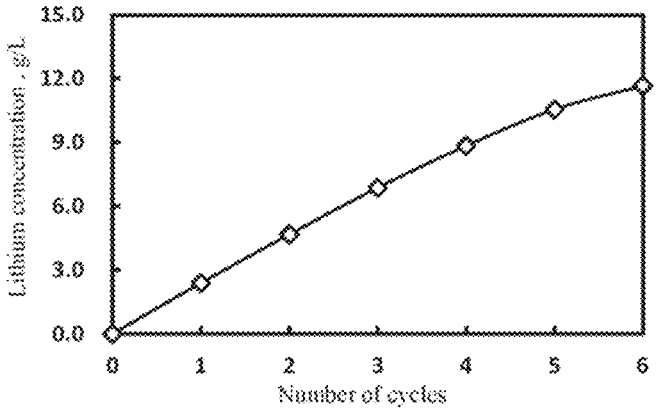
FIG. 10 shows the variation of lithium concentration in the supporting electrolyte during the cyclic use in Example 7.

It can be seen from FIG. 10 that by cyclic enrichment of the supporting electrolyte, the lithium concentration can be further enriched, and the lithium concentration can reach 11.5 g/L after 6 cycles.

TABLE 4

Components of carbonate type salt lake brine (g/L)

| Element | $Li^+$ | $Na^+$ | $K^+$ | $SO_4^{2-}$ | $CO_3^{2-}$ | $B_2O_3$ |
|---|---|---|---|---|---|---|
| Raw brine | 0.67 | 97.2 | 15.3 | 10.3 | 21.8 | 4.5 |
| Brine after lithium extraction | 0.08 | 96.9 | 15.25 | 10.26 | 21.7 | 4.48 |
| Lithium-rich solution | 2.38 | 3.16 | 0.18 | 0.14 | 0.3 | 0.06 |

Comparative Example 1

(1) A lithium iron phosphate slurry and a lithium-deficient iron phosphate slurry were prepared using lithium iron phosphate as a lithium-rich active material by the same method as in Example 1. The lithium iron phosphate slurry and the lithium-deficient iron phosphate slurry were coated on two sides of titanium sheets (wherein the size of the titanium sheet was 50×50 $cm^2$, and the two sides were of the same material), with the same coating density as that in the example and dried under the same conditions as those in Example 1, to respectively prepare lithium iron phosphate electrodes and lithium-deficient iron phosphate electrodes.

(2) The electrolytic cell was divided into 10 independent chambers by nine anion membranes, and five lithium iron phosphate electrodes and five lithium-deficient iron phosphate electrodes were alternately placed in the independent chambers. Each lithium iron phosphate electrode was connected to a positive electrode of a power supply through a wire, and each lithium iron phosphate electrode was connected to a negative electrode of the power supply, to form a membrane stack lithium extraction electrolytic cell with a conventional connection manner and working mode.

(3) 300 L of salt lake brine the same as that in Example 1 was injected into each of the chambers where the lithium iron phosphate electrodes were located (wherein the injection and outflow of the solution in each chamber can be connected through external pipes), and 20 L of 5 g/L NaCl as a supporting electrolyte was injected into the lithium-deficient iron phosphate electrode. Electrolytic lithium extraction was performed at a voltage of 0.35 V, and the lithium extraction process was terminated when the lithium extraction current decreased to 10% of the initial current.

Comparative Example 2

The difference between this comparative example and Comparative Example 1 only lies in that the lithium iron phosphate in the step (1) of Comparative Example 1 was replaced by $LiMn_2O_4$, and the electrolysis was carried out at a voltage of 0.65 V during the lithium extraction process.

Comparative Example 3

The difference between this comparative example and Comparative Example 1 only lies in that the lithium iron phosphate in the step (1) of Comparative Example 1 was replaced by $LiNi_{0.5}Co_{0.2}Mn_{0.3}O_2$, and the electrolysis was carried out at a voltage of 0.7 V during the lithium extraction process.

Figure 11:
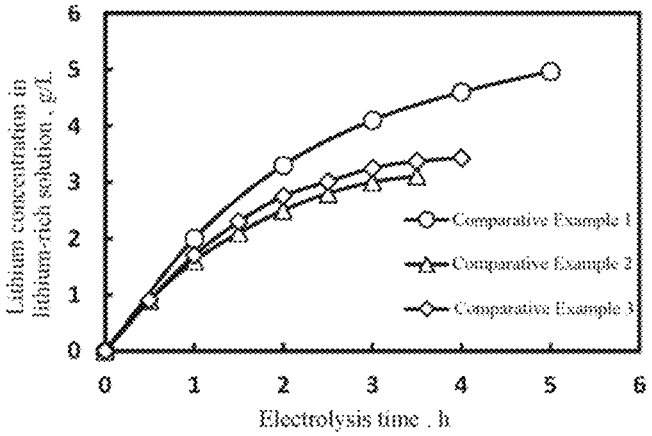
FIG. 11 shows the variation of lithium concentration in the supporting electrolyte in the lithium extraction process in Comparative Examples 1-3.
Figure 12:
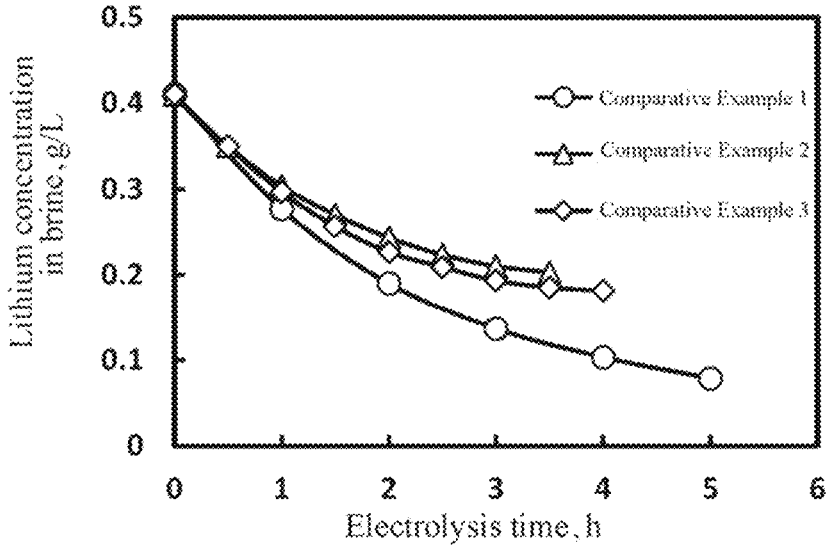
FIG. 12 shows the variation of lithium concentration in brine with time in the lithium extraction process in Comparative Examples 1-3.

The concentrations of main ions in the brine and the lithium-rich solution before and after lithium extraction in Comparative Examples 1-3 were as shown in Table 5. The variation of the lithium concentration with time during the process was as shown in FIG. 11 and FIG. 12.

TABLE 5

Concentrations of main ions in the brine and the lithium-rich solution before and after lithium extraction

| Comparative Example | Lithium extraction system | Voltage (V) | Average current (A) | Residual lithium concentration in brine | Ion concentration in lithium-rich solution Li | Na | Mg | K |
|---|---|---|---|---|---|---|---|---|
| Comparative Example 1 | $LiFePO_4$ and $Li_{0.1}FePO_4$ | 0.35 V | 76.4 | 0.08 | 4.97 | 3.33 | 1.23 | 0.13 |
| Comparative Example 2 | $LiMn_2O_4$ and $Li_{0.2}Mn_2O_4$ | 0.65 V | 68.4 | 0.203 | 3.11 | 3.42 | 1.15 | 0.12 |
| Comparative Example 3 | $Li_{0.15}Ni_{0.5}Co_{0.2}Mn_{0.3}O_2$ and $LiNi_{0.5}Co_{0.2}Mn_{0.3}O_2$ | 0.7 V | 69.5 | 0.18 | 3.43 | 3.24 | 1.21 | 0.13 |

Compared with the lithium extraction methods of Examples 1-3, the lithium extraction effects of Comparative Examples 1-3 are comparable, and the adsorption capacities in Comparative Examples 1-3 can reach 26.5 mg/g, 16.6 mg/g, and 18.3 mg/g. However, by comparing the process currents, it can be clearly seen that when the same number of electrodes are adopted, the current of the comparative examples is up to about 70 A, which is about 10 times that of Examples 1-3. In the actual production process, in order to ensure the lithium extraction number of each membrane stack electrolytic cell, 100 to 200 electrode plates need to be assembled in one electrolytic cell. In this case, when the working mode of Comparative Examples 1-3 is adopted, the current will be 100-200 times that of the method of the present invention, resulting in a too large current of the lithium extraction system. Consequently, not only the fabrication costs of the power supply are increased, but also cause the busbar voltage drop caused by high current operation will have a huge impact on the working conditions of the electrodes of the electrolytic cell. The lithium extraction method using bipolar electrodes of the present invention can fundamentally solve the above problems.

Described above are only specific implementations of the present invention, but the protection scope of the present invention is not limited thereto. Any variation or replacement that can be easily figured out by those skilled in the art within the technical scope disclosed in the present invention shall fall within the protection scope of the present invention. Therefore, the protection scope of the present invention is defined by the appended claims.

What is claimed is:

1. An apparatus for extracting lithium from a solution using bipolar electrodes, comprising a cell body, end electrodes, at least one conductive separator, and anion membranes, wherein a number of the anion membranes is greater than a number of the at least one conductive separator;

wherein the end electrodes comprise a first end electrode and a second end electrode respectively disposed at two ends of the cell body, the first end electrode is configured to connect to a first electrode, and the second end electrode is configured to connect to a second electrode; a surface of the first end electrode facing the second end electrode is coated with a lithium-deficient electroactive material, and a surface of the second end electrode facing the first end electrode is coated with a lithium-rich electroactive material;

wherein the at least one conductive separator is disposed inside the cell body to physically divide the cell body into two or more independent chambers, and the at least one conductive separator is located between the first end electrode and the second end electrode; a first surface of the at least one conductive separator facing the first end electrode is coated with the lithium-rich electroactive material, and a second surface of the at least one conductive separator facing the second end electrode is coated with the lithium-deficient electroactive material; and wherein one of the anion membranes is disposed in each of the independent chambers to divide the each of the independent chambers into two working areas, one of the two working areas is on a lithium-deficient electroactive material side and is used for introducing a lithium-containing raw material solution and is called a first working area, and the other of the two working areas is on a lithium-rich electroactive material side and is used for introducing a supporting electrolyte solution and is called a second working area.

2. The apparatus for extracting the lithium from the solution using the bipolar electrodes according to claim 1, wherein the first end electrode, the second end electrode, the at least one conductive separator, and the anion membranes are disposed in parallel with each other, and a plurality of the at least one conductive separator is spaced apart from each other by a same distance.

3. The apparatus for extracting the lithium from the solution using the bipolar electrodes according to claim 1, wherein at least one engagement groove for mounting the at least one conductive separator is provided in the cell body.

4. The apparatus for extracting the lithium from the solution using the bipolar electrodes according to claim 1, wherein the lithium-rich electroactive material is at least one of $LiFePO_4$, $LiMn_2O_4$, $LiMeO_2$, and doped derivatives of the $LiFePO_4$, the $LiMn_2O_4$, and the $LiMeO_2$, wherein Me is one or more of Ni, Co, or Mn; and the lithium-deficient electroactive material is prepared by oxidizing the lithium-rich electroactive material to remove a part or all of the lithium.

5. The apparatus for extracting the lithium from the solution using the bipolar electrodes according to claim 1, wherein the at least one conductive separator is a carbon paper; a carbon fiber sintered cloth; a graphite plate; a corrosion-resistant intermetallic compound plate; a ruthenium-coated titanium sheet; a plate of gold, a platinum group metal, and/or an alloy of the gold and the platinum group metal; or a plate of titanium, zirconium, hafnium, tantalum, niobium, and/or an alloy of the titanium, the zirconium, the hafnium, the tantalum, and the niobium.

6. A method for extracting lithium from a solution using bipolar electrodes, comprising the following steps:

step 1: taking the apparatus for extracting the lithium from the solution using the bipolar electrodes according to claim 1, introducing the lithium-containing raw material solution into the first working area, and introducing the supporting electrolyte solution into the second working area;

step 2: connecting the first end electrode to a negative electrode of a power supply, connecting the second end electrode to the negative electrode of the power supply, turning on the power supply, a current flowing in from the second end electrode and being outputted from the first end electrode, and at the same time, the following changes occur:

lithium ions in the lithium-containing raw material solution in the first working area are intercalated in the lithium-deficient electroactive material, and the lithium-deficient electroactive material becomes the lithium-rich electroactive material; and lithium ions are deintercalated from the lithium-rich electroactive material in the second working area and enter the supporting electrolyte solution, and the lithium-rich electroactive material becomes the lithium-deficient electroactive material;

step 3: when the lithium-containing raw material solution has changed into a lithium-deficient solution and the supporting electrolyte solution has changed into a lithium-rich solution, disconnecting the power supply, discharging the lithium-deficient solution, and collecting the lithium-rich solution; and step 4: cleaning the cell body, connecting the first end electrode to a positive electrode of the power supply, connecting the second end electrode to the negative electrode of the power supply, and repeating the steps 1-3.

7. The method for extracting the lithium from the solution using the bipolar electrodes according to claim 6, wherein the lithium-rich solution from one cycle is used as the supporting electrolyte solution in a next cycle for a lithium extraction to increase a concentration of the lithium in the solution; and the lithium-deficient solution from the one cycle is used as the lithium-containing raw material solution for the lithium extraction in the next cycle to improve a recovery rate of the lithium.

8. The method for extracting the lithium from the solution using the bipolar electrodes according to claim 6, wherein the lithium-containing raw material solution for a lithium extraction is at least one of a raw salt lake brine, a brine of any stage obtained by a treatment of an original brine, an old brine, an underground brine, an oil field brine, a lithium-containing solution obtained from an ore decomposition and a secondary resource recovery, or a lithium precipitation mother liquor.

9. The method for extracting the lithium from the solution using the bipolar electrodes according to claim 6, wherein a value of a voltage of the power supply is (0.1-1.0)×n V, wherein n is a number of the independent chambers.

10. The method for extracting the lithium from the solution using the bipolar electrodes according to claim 9, wherein when the lithium-rich electroactive material is $LiFePO_4$ or a derivative of the $LiFePO_4$, an external voltage applied is (0.1-0.5)×n V;

when the lithium-rich electroactive material is $LiMn_2O_4$ or a derivative of the $LiMn_2O_4$, an external voltage applied is (0.3-0.6)×n V;

when the lithium-rich electroactive material is $LiMeO_2$ or a derivative of the $LiMeO_2$, an external voltage applied is (0.4-0.8)×n V;

when the lithium-rich electroactive material is $LiMn_2O_4$, $LiFePO_4$, and a derivative of the $LiMn_2O_4$ or the $LiFePO_4$, an external voltage applied is (0.3-0.7)×n V;

when the lithium-rich electroactive material is $LiMn_2O_4$, $LiMeO_2$, and a derivative of the $LiMn_2O_4$ or the $LiMeO_2$, an external voltage applied is (0.4-0.9)×n V; or when the lithium-rich electroactive material is $LiFePO_4$, $LiMeO_2$, and a derivative of the $LiFePO_4$ or $LiMeO_2$, an external voltage applied is (0.4-1.0)×n V.

11. The method for extracting the lithium from the solution using the bipolar electrodes according to claim 6, wherein in the apparatus for extracting the lithium from the solution using the bipolar electrodes, the first end electrode, the second end electrode, the at least one conductive separator, and the anion membranes are disposed in parallel with each other, and a plurality of the at least one conductive separator is spaced apart from each other by a same distance.

12. The method for extracting the lithium from the solution using the bipolar electrodes according to claim 6, wherein in the apparatus for extracting the lithium from the solution using the bipolar electrodes, at least one engagement groove for mounting the at least one conductive separator is provided in the cell body.

13. The method for extracting the lithium from the solution using the bipolar electrodes according to claim 6, wherein in the apparatus for extracting the lithium from the solution using the bipolar electrodes, the lithium-rich electroactive material is at least one of $LiFePO_4$, $LiMn_2O_4$, $LiMeO_2$, and doped derivatives of the $LiFePO_4$, the $LiMn_2O_4$, and the $LiMeO_2$, wherein Me is one or more of Ni, Co, or Mn; and the lithium-deficient electroactive material is prepared by oxidizing the lithium-rich electroactive material to remove a part or all of the lithium.

14. The method for extracting the lithium from the solution using the bipolar electrodes according to claim 6, wherein in the apparatus for extracting the lithium from the solution using the bipolar electrodes, the at least one conductive separator is a carbon paper; a carbon fiber sintered cloth; a graphite plate; a corrosion-resistant intermetallic compound plate; a ruthenium-coated titanium sheet; a plate of gold, a platinum group metal, and/or an alloy of the gold and the platinum group metal; or a plate of titanium, zirconium, hafnium, tantalum, niobium, and/or an alloy of the titanium, the zirconium, the hafnium, the tantalum, and the niobium.

15. The method for extracting the lithium from the solution using the bipolar electrodes according to claim 11, wherein the lithium-rich solution from one cycle is used as the supporting electrolyte solution in a next cycle for a lithium extraction to increase a concentration of the lithium in the solution; and the lithium-deficient solution from the one cycle is used as the lithium-containing raw material solution for the lithium extraction in the next cycle to improve a recovery rate of the lithium.

16. The method for extracting the lithium from the solution using the bipolar electrodes according to claim 11, wherein the lithium-containing raw material solution for a lithium extraction is at least one of a raw salt lake brine, a brine of any stage obtained by a treatment of an original brine, an old brine, an underground brine, an oil field brine, a lithium-containing solution obtained from an ore decomposition and a secondary resource recovery, or a lithium precipitation mother liquor.

17. The method for extracting the lithium from the solution using the bipolar electrodes according to claim 11, wherein a value of a voltage of the power supply is (0.1-1.0)×n V, wherein n is a number of the independent chambers.

18. The method for extracting the lithium from the solution using the bipolar electrodes according to claim 12, wherein the lithium-rich solution from one cycle is used as the supporting electrolyte solution in a next cycle for a lithium extraction to increase a concentration of the lithium in the solution; and the lithium-deficient solution from the one cycle is used as the lithium-containing raw material solution for the lithium extraction in the next cycle to improve a recovery rate of the lithium.

19. The method for extracting the lithium from the solution using the bipolar electrodes according to claim 12, wherein the lithium-containing raw material solution for a lithium extraction is at least one of a raw salt lake brine, a brine of any stage obtained by a treatment of an original brine, an old brine, an underground brine, an oil field brine, a lithium-containing solution obtained from an ore decomposition and a secondary resource recovery, or a lithium precipitation mother liquor.

20. The method for extracting the lithium from the solution using the bipolar electrodes according to claim 12, wherein a value of a voltage of the power supply is (0.1-1.0)×n V, wherein n is a number of the independent chambers.

* * * * *